US006892448B2

(12) United States Patent
Gecic

(10) Patent No.: US 6,892,448 B2
(45) Date of Patent: May 17, 2005

(54) AUTOMATED ROLL PACKING APPARATUS

(75) Inventor: Josip Gecic, Koprivnica (HR)

(73) Assignee: L&P Property Management Co., South Gate, CA (US)

( * ) Notice: Subject to any disclaimer, the term of this patent is extended or adjusted under 35 U.S.C. 154(b) by 117 days.

(21) Appl. No.: 10/278,293

(22) Filed: Oct. 23, 2002

(65) Prior Publication Data

US 2003/0079339 A1 May 1, 2003

Related U.S. Application Data

(60) Provisional application No. 60/347,449, filed on Nov. 1, 2001.

(51) Int. Cl.[7] ..... B23P 21/00; B65B 63/04

(52) U.S. Cl. ..... 29/779; 29/771; 53/430

(58) Field of Search ..... 29/771, 779, 780, 29/784, 786, 819, 820, 822; 53/430, 118, 114; 242/528, 530, 541

(56) References Cited

U.S. PATENT DOCUMENTS

| | | | | |
|---|---|---|---|---|
| 1,144,697 | A | 6/1915 | Delaney | |
| 2,114,008 | A | 4/1938 | Wunderlich | 100/1 |
| 2,311,383 | A | 2/1943 | Hardenberg | 242/72 |
| 3,122,089 | A | 2/1964 | Sinclair | 100/40 |
| 3,129,658 | A | 4/1964 | Valente | 100/218 |
| 3,270,976 | A | 9/1966 | Smith | 242/78.1 |
| 3,521,424 | A | 7/1970 | Wirfel | 53/24 |
| 3,927,504 | A | 12/1975 | Forrister | 53/21 FW |
| 3,964,232 | A | 6/1976 | Bender et al. | 53/21 FW |
| 4,109,443 | A | 8/1978 | Findlay | 53/118 |
| 4,377,262 | A | 3/1983 | Zajac | 242/1 |
| 4,385,478 | A | 5/1983 | Veerkamp | 53/118 |
| 4,507,947 | A | 4/1985 | Stanley | 72/130 |
| 4,532,750 | A | 8/1985 | Meier | 53/118 |
| 4,550,550 | A | 11/1985 | Scott | 53/529 |
| 4,711,067 | A | 12/1987 | Magni | 53/439 |
| 4,775,111 | A | 10/1988 | Kalin | 242/59 |
| 4,967,536 | A | 11/1990 | Reist | 53/118 |
| 5,101,610 | A | 4/1992 | Honegger | 53/430 |
| 5,121,584 | A | 6/1992 | Suter | 53/116 |
| 5,495,700 | A | 3/1996 | Stauber et al. | 53/118 |
| 5,765,343 | A | 6/1998 | Whittaker | 53/430 |
| 5,934,041 | A | 8/1999 | Rudolf et al. | 53/118 |
| 5,934,046 | A | 8/1999 | Whittaker | 53/430 |
| 6,098,378 | A | 8/2000 | Wyatt | 53/430 |
| 6,357,209 | B1 | 3/2002 | Mossbeck et al. | 53/430 |
| 6,467,239 | B2 | 10/2002 | Mossbeck et al. | 53/430 |

*Primary Examiner*—John C. Hong
(74) *Attorney, Agent, or Firm*—Wood, Herron & Evans L.L.P.

(57) ABSTRACT

An apparatus for fully automated roll packing of compressible mattress spring assemblies, including a radially collapsible mandrel for easy removal of finished rolls. In-fed spring assemblies are precompressed prior to winding on the mandrel, which is mounted to a pivotable arm to permit controlled compression of the spring assemblies against a fixed compression roller. The apparatus further includes devices for placing the finished rolls on pallets and wrapping pallets for shipping and storage.

23 Claims, 5 Drawing Sheets

AUTOMATED ROLL PACKING APPARATUS

Pursuant to 37 C.F.R. § 1.78(a)(4), this application claims the benefit of and priority to prior filed co-pending Provisional Application Ser. No. 60/347,449, filed Nov. 1, 2001, which is expressly incorporated herein by reference.

FIELD OF THE INVENTION

This invention relates to the packaging of compressible spring assemblies used in the manufacture of mattresses and the like, and is more particularly directed to an apparatus for packaging such compressible spring assemblies into a roll.

BACKGROUND OF THE INVENTION

A large majority of mattresses are manufactured with inner spring assemblies. These inner spring assemblies are comprised of a multitude of interconnected coil springs arranged in a matrix of rows and columns of springs. The inner spring assemblies are most often shipped in a stacked and compressed condition. It has been found that such inner spring assemblies and the finished mattresses made from the spring assemblies can be compressed and packaged into a roll, providing improvements in efficiency of storing and shipping the mattresses and spring assemblies. Roll packing generally involves winding up spring assemblies or mattresses to form a roll and then securing the roll to prevent uncoiling during handling and storage. In many applications it is desired to incorporate a packing material into the wound roll such that the packing material is positioned between successive layers of the roll to keep each layer separate and to aid in the removal of individual spring assemblies or mattresses from the roll. U.S. Pat. No. 2,114,008 to Wunderlich discloses a machine for packaging spring assemblies into a roll.

Roll packing machines of the prior art are generally very labor intensive, requiring the close attention of an operator at various stages of the roll packing process. For example, in the apparatus disclosed by Wunderlich, an operator must manually start the feeding of packing material to a mandrel for winding the spring assemblies into a roll. Operators must also manually feed the compressible spring assemblies to the mandrel and manually cut and secure the packing material at the end of a roll to prevent premature uncoiling of the roll packed assemblies. When a roll of spring assemblies is complete, the operator must remove the mandrel from the machine and manually collapse the mandrel to remove the finished roll.

Another drawback of prior roll packing machines is that operators must manually change out rolls of packing material to switch to a new type of material or to replace a spent roll. These labor intensive operations consume a considerable amount of time, often during which time the roll packing machine may not be operated. Labor intensive operations also increase the possibility for human error which lead to inconsistent quality of roll packed material. For at least the reasons discussed above, a need exists for a roll packing machine which reduces labor intensive operations and improves efficiency and ergonomics of roll packing spring assemblies to provide roll packed units of consistent quality in shorter cycle times.

SUMMARY OF THE INVENTION

The present invention provides an improved machine for roll packing mattress spring assemblies. The machine is fully automated to permit efficient roll packing of spring assemblies of consistent quality. To this end and in accordance with the present invention, an apparatus is provided having a radially collapsible mandrel for winding in-fed spring assemblies into a roll. The mandrel is mounted to an arm that can be pivoted about an axis of the arm to move the mandrel toward and away from a fixed compression roller, whereby the in-fed spring assemblies are compressed in a controllable manner as they are wound upon the mandrel.

The apparatus also includes an automated feeding system which includes rollers to precompress in-fed spring assemblies and a moving guide system for controlling the spacing of the spring assemblies. Packing material is automatically fed to the spring assemblies as they are rolled on the mandrel, and a cutting and gluing unit automatically cuts the packing material and applies an adhesive to a final layer of packing material to secure the finished roll.

A roll pusher removes finished rolls of spring assemblies from the collapsed mandrel and a finished roll manipulator places the finished rolls on an automated palletizer which wraps pallets of finished rolls for shipping and storage. The apparatus further includes a controller and power supply which control the operation of the apparatus and provide power to various driving systems of the apparatus.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

An apparatus is provided for fully automated roll packing of spring assemblies which reduces labor intensive operations and provides faster cycle times. The present invention may be described and understood by a description of an exemplary apparatus.

Figure 1:
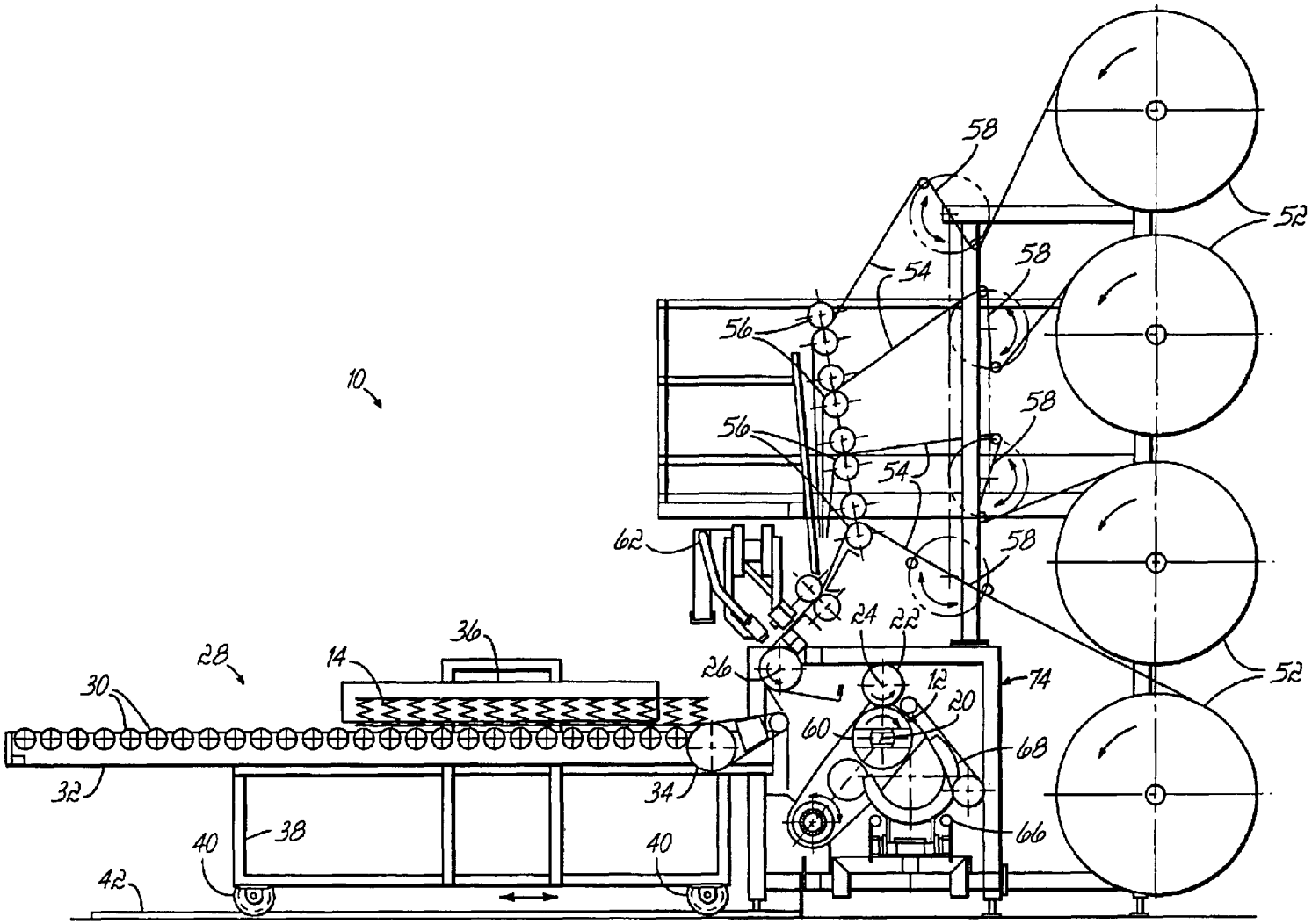
FIG. 1 is an elevational view of a roll packing apparatus according to the principles of the present invention.

With reference to FIG. 1, there is shown an illustration of one embodiment of a roll packing apparatus 10 incorporating the principles of the present invention. The apparatus 10 includes a radially collapsible mandrel 12 for receiving in-fed spring assemblies 14 and winding them into a roll. Collapsible mandrel 12 is attached to a pivot arm 16 having pivot axis 18. The collapsible mandrel 12 has a rotational axis 20 which is substantially parallel to the pivot axis 18. A fixed compression roller 22 is located proximate the mandrel 12 and has a rotational axis 24 substantially parallel to the rotational axis 20 of the mandrel 12.

Pivot arm 16 pivots about pivot axis 18 to position the mandrel 12 relative to the fixed compression roller 22 to compress in-fed spring assemblies 14 in a controllable manner as they are wound upon the mandrel 12. The apparatus 10 further includes a precompression guide roller 26 upstream of the mandrel 12 for receiving in-fed spring assemblies 14 and directing them toward the mandrel 12 and fixed compression roller 22. The precompression guide roller 26 provides a gradual initial compression of the spring assemblies 14 prior to being further compressed between the mandrel 12 and fixed compression roller 22. Advantageously, the precompression guide roller 26 provides precompression to spring assemblies 14 having tall or small diameter springs which are susceptible to shifting that would otherwise occur if they were subjected to rapid compression by being directed to the fixed compression roller 22 and mandrel 12 without any precompression.

A feed table 28 upstream of the precompression guide roller 26 supports in-fed spring assemblies 14 and directs them toward the precompression guide roller 26. The feed table 28 includes a plurality of rollers 30 disposed on a support surface 32 of the feed table 28 to transport spring assemblies 14 toward the precompression guide roller 26. The feed table 28 further includes a precompression conveyer 34 which operates in conjunction with the precompression guide roller 26 to precompress spring assemblies 14 and automatically feed the spring assemblies 14 between the mandrel 12 and fixed compression roller 22. Moving side guides 36 on the feed table 28 aid in automatically in-feeding the spring assemblies 14 and ensure proper spacing between the in-fed spring assemblies 14. The feed table 28 includes a frame 38 having casters 40 located at the bottom of the frame 38 to allow movement of the feed table 28 toward and away from the precompression guide roller 26. The casters 40 are positioned on guide rails 42 which control the path of the feed table 28. Drive motors 44, 46, 48, 50 coupled to the feed table frame 38, the feed table rollers 30, the side guides 36, and the precompression conveyor 34 provide the motive forces to move spring assemblies 14 along the feed table 28 and between the precompression roller 26 and conveyor 34 to be directed to the mandrel 12 for winding.

Figure 2:
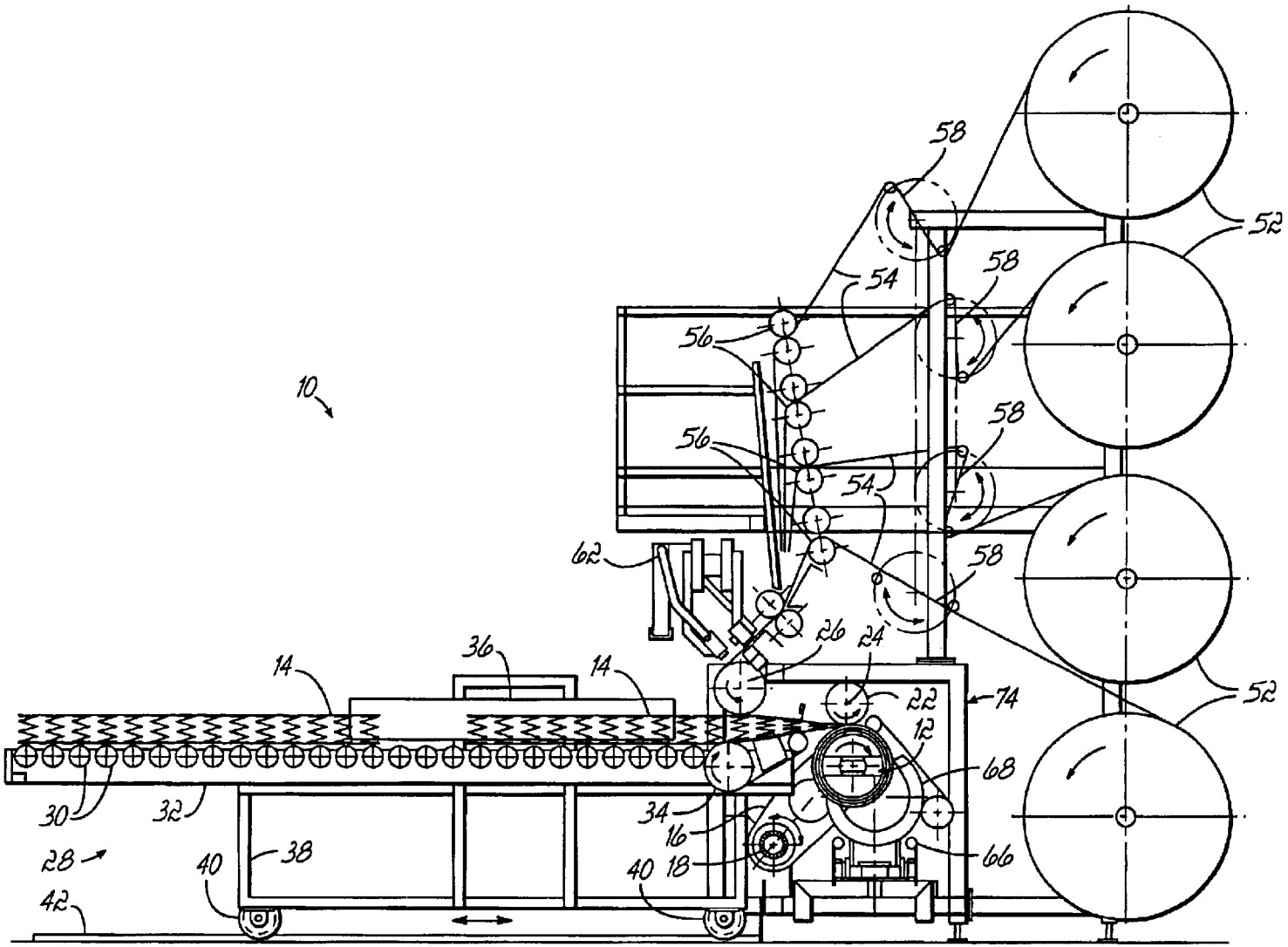
FIG. 2 is an elevational view of the roll packing apparatus of FIG. 1 depicting a spring assembly being fed between precompression rollers and directed to the mandrel.

The apparatus 10 includes one or more packing material dispensers 52 positioned near the mandrel 12 for receiving and dispensing packing material 54, such as paper, foil, or various fabric materials, to the in-fed spring assemblies 14 as they are being wound upon the mandrel 12. Each packing material dispenser 52 has associated packing material feed rollers 56 and a tension compensator 58 for feeding and directing packing material 54 from the dispenser 52 toward the mandrel 12 and fixed compression roller 22. The packing material feed rollers may be supported on pneumatic cylinders whereby the position of the feed rollers may be adjusted. As spring assemblies 14 are directed through the precompression guide roller 26 toward the mandrel 12 and fixed compression roller 22, packing material 54 is pushed toward the mandrel 12 by the spring assemblies 14. The mandrel 12 includes a vacuum system which draws the packing material 54 toward a surface 60 of the mandrel 12 so that it is wound tightly upon the mandrel 12 prior to compressing and winding of spring assemblies 14 upon the mandrel 12. Referring further to FIG. 2, as spring assemblies 14 are wound upon the mandrel 12, pivot arm 16 pivots about pivot axis 18 to move the mandrel 12 away from the fixed compression roller 22 in a controlled manner so that successive spring assemblies 14 are uniformly compressed and rolled upon the mandrel 12.

Figure 3:
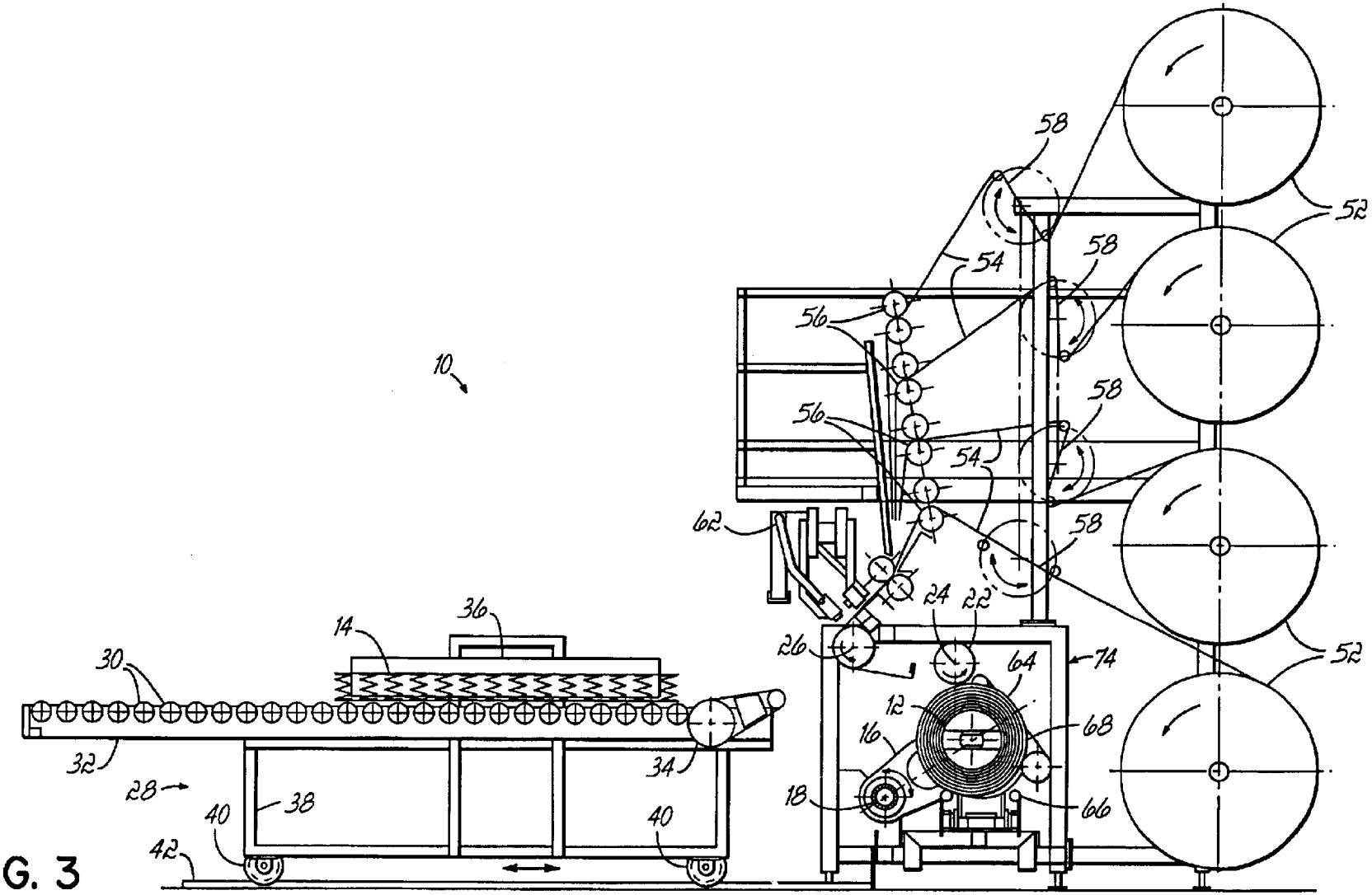
FIG. 3 is an elevational view of the roll packing apparatus of FIG. 1 depicting a fully wound roll of spring assemblies on the mandrel.
Figure 4:
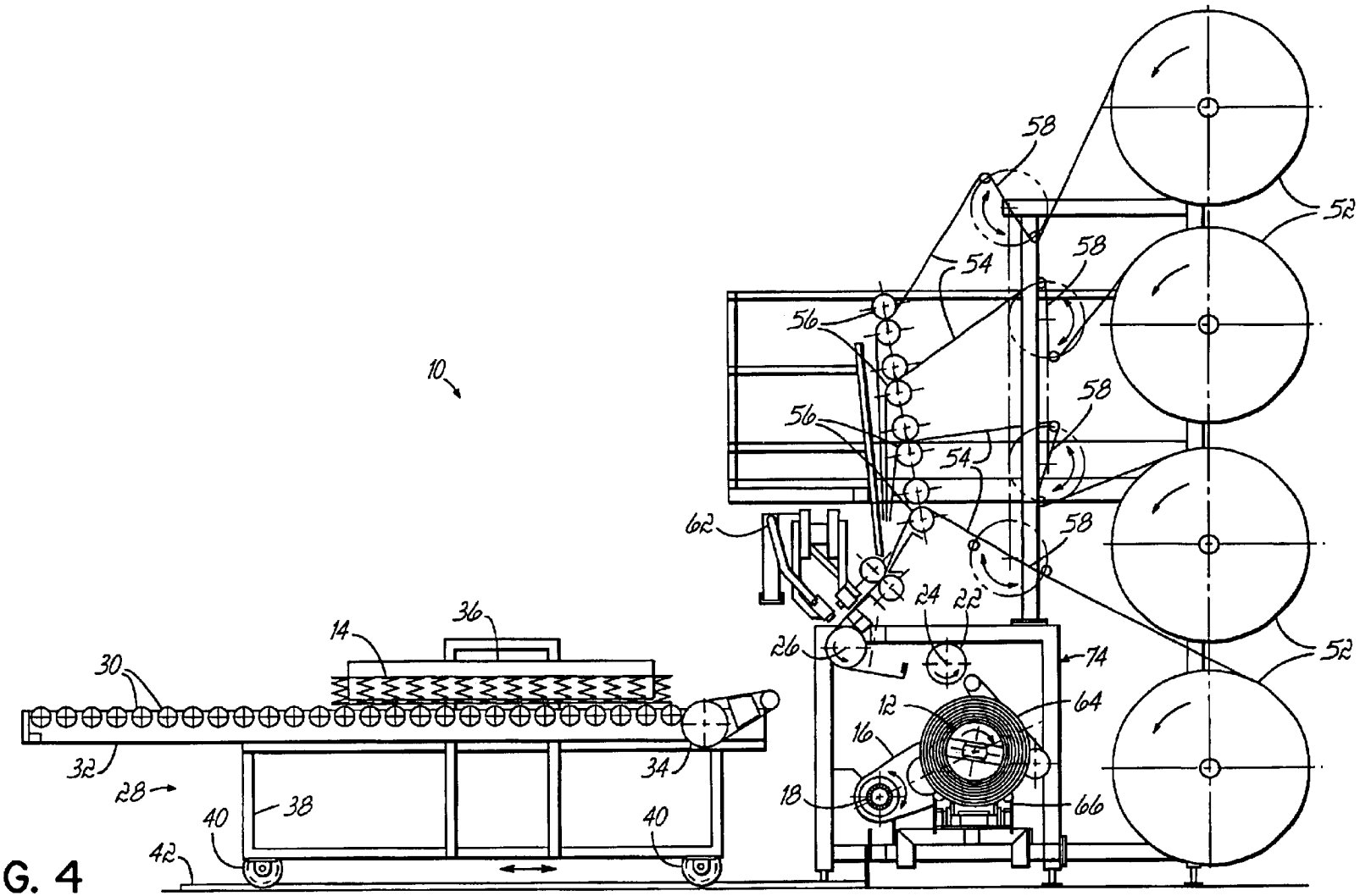
FIG. 4 is an elevational view of the roll packing apparatus of FIG. 1 depicting a finished roll of spring assemblies in position against the fixed compression roller after a gluing step.

The apparatus 10 further includes an automated cutting and gluing unit 62 in line between the packing material dispensers 52 and the mandrel 12. The cutting and gluing unit 62 automatically cuts the packing material 54 near the end of a finished roll 64 of compressed spring assemblies 14 and applies adhesive to a final layer of packing material 54, which is wound to secure the finished roll 64. Referring to FIG. 3, pivot arm 16 holds the finished roll 64, still on the mandrel 12, against the fixed compression roller 22 to provide pressure to the end of the final layer of packing material 54 until the adhesive has cured and the finished roll 64 may be removed from the mandrel 12. Referring to FIG. 4, pivot arm 16 rotates to move the finished roll 64 away from the fixed compression roller 22 and places the finished roll 64 on a finished roll support 66. At this point, the mandrel 12 may be collapsed radially inward to release the finished roll 64 and a roll pusher 68 is activated to push the finished roll 64 off the mandrel 12 along the finished roll support 66.

Figure 5:
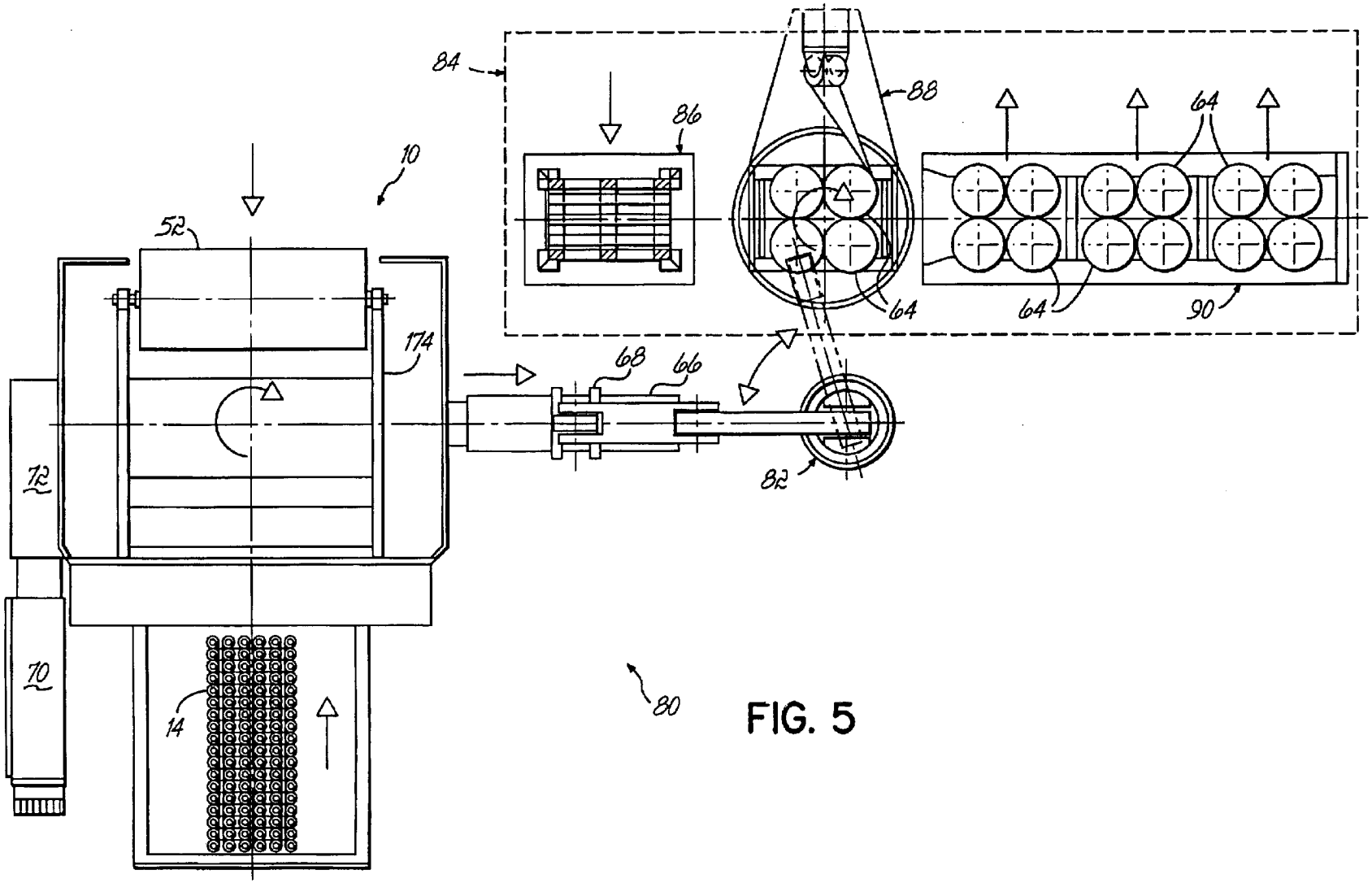
FIG. 5 is a plan view of the roll packing apparatus of the present invention, further including a finished roll manipulator, a pallet magazine, and a finished roll palletizer.

Referring to FIG. 5, the apparatus 10 further includes a controller 70 connected to the various drive motors and to sensors positioned at various locations on the apparatus 10 for controlling the automated roll packing of spring assemblies 14, as described above. The controller 70 is also configured to count the number of spring assemblies 14 that have been wound upon the mandrel 12. A power supply 72 provides electrical current to the apparatus 10 and its components. While the apparatus 10 is designed for completely automated roll packing of spring assemblies, it can also be used without an automated feed table 28 when manual feeding of spring assemblies 14 is desired. As more clearly shown in FIG. 1, the roll packing apparatus 10 includes a frame structure 74 for supporting the components described above. The frame structure 74 may be configured to have a modular design, wherein various sections of the apparatus 10 may be separately assembled and disassembled to facilitate transportation and assembly of the apparatus 10.

Referring to FIG. 5, an automated system 80 for providing roll packed spring assemblies 14 includes a roll packing apparatus 10, as described above, and further includes a finished roll manipulator 82 which receives finished rolls 64 of spring assemblies 14 from the finished roll support 66 and moves them to a finished roll palletizer 84. The finished roll palletizer 84 includes a pallet magazine 86, a roll wrapping machine 88 for wrapping finished rolls 64 for shipment and storage, and a conveyor 90.

In one exemplary embodiment, a roll packing apparatus 10 according to the principles of the present invention has a radially collapsible mandrel 12 having a diameter of about 300 mm. The exemplary apparatus 10 can receive rolls of packing material 54 up to about 2100 mm in width and about 1000 mm in diameter, and can accommodate spring assemblies 14 up to about 200-mm wide and about 240-mm high. The exemplary apparatus 10 can produce finished rolls 64 of spring assemblies 14 of up to about 650 mm in diameter, each roll containing 10–12 spring assemblies 14, at a rate of about 12–20 rolls per hour.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of Applicant's general inventive concept.

What is claimed is:

1. An apparatus for roll packing mattress spring assemblies comprising:

a pivot arm having a pivot axis about which the pivot arm may be rotated;

an elongated, radially collapsible mandrel rotationally supported on the pivot arm, the collapsible mandrel having a rotational axis along its length whereby spring assemblies may be wound upon the mandrel by rotating the mandrel; and a fixed compression roller having a rotational axis substantially parallel to the rotational axis of the mandrel and operatively associated with the mandrel to compress in-fed spring assemblies.

2. The apparatus of claim 1, further comprising:

a precompression guide roller proximate the mandrel for receiving in-fed spring assemblies and directing the spring assemblies toward the mandrel while simultaneously compressing the spring assemblies; and a feed table upstream of the precompression guide roller for supporting the in-fed spring assemblies and directing the spring assemblies toward the precompression guide roller.

3. The apparatus of claim 2, further comprising:

guide rails upstream of the precompression guide roller; and castors fixed to the feed table and engageable with the guide rails such that the feed table may be moved toward and away from the precompression guide roller along a path defined by the guide rails.

4. The apparatus of claim 2 further comprising:

a precompression conveyor supported on the feed table, whereby the precompression conveyor acts operatively with the precompression guide roller to precompress in-fed spring assemblies and automatically feed the spring assemblies proximate the mandrel and fixed compression roller.

5. The apparatus of claim 2 further comprising:

side guides operatively associated with the feed table to facilitate feeding of spring assemblies to the mandrel and to ensure proper spacing between successive spring assemblies.

6. The apparatus of claim 1, further comprising:

at least one packing material dispenser proximate the mandrel for receiving and dispensing packing material to the in-fed spring assemblies as they are being wound upon the mandrel.

7. The apparatus of claim 6, further comprising:

at least one feed roller operatively associated with the packing material dispenser, for feeding packing material to the spring assemblies as they are wound upon the mandrel.

8. The apparatus of claim 6, further comprising:

a pneumatic cylinder operatively associated with the feed roller to adjust the position of the feed roller.

9. The apparatus of claim 6, further comprising:

a vacuum system operatively associated with the mandrel, the vacuum system operating to draw packing material toward the mandrel and facilitate winding of the packing material on the mandrel.

10. The apparatus of claim 6, further comprising:

a tension compensator associated with the packing material dispenser.

11. The apparatus of claim 1, further comprising:

a cutting and gluing module upstream of the mandrel and constructed to cut the packing material near the end of a finished roll and to apply adhesive to the end of the packing material to secure the finished roll.

12. The apparatus of claim 1, further comprising:

a finished roll support proximate the mandrel for receiving a finished roll of packed spring assemblies; and a roll pusher proximate the first end of the mandrel and configured to engage a finished roll of spring assemblies on the mandrel and push the roll toward the second end and off of the mandrel onto the finished roll support.

13. The apparatus of claim 1, further comprising:

a finished roll manipulator; and a finished roll palletizer, the finished roll palletizer including:

a pallet magazine, and a roll wrapping machine.

14. The apparatus of claim 13, further comprising:

a conveyor for receiving finished, wrapped rolls of roll packed spring assemblies.

15. An apparatus for roll packing mattress spring assemblies comprising:

a pivot arm having a pivot axis about which the pivot arm may be rotated;

an elongated, radially collapsible mandrel rotationally supported on the pivot arm, the collapsible mandrel having a rotational axis along its length whereby spring assemblies may be wound upon the mandrel by rotating the mandrel, and having a first end and a second end;

a fixed compression roller having a rotational axis substantially parallel to the rotational axis of the mandrel and operatively associated with the mandrel to compress in-fed spring assemblies a precompression guide roller proximate the mandrel for receiving in-fed spring assemblies and directing the spring assemblies toward the mandrel while simultaneously compressing the spring assemblies;

a feed table upstream of the precompression guide roller for supporting the in-fed spring assemblies and directing the spring assemblies toward the precompression guide rollers;

at least one packing material dispenser proximate the mandrel for receiving and dispensing packing material to the in-fed spring assemblies as they are being wound upon the mandrel;

at least one feed roller operatively associated with the packing material dispenser, for feeding packing material to the spring assemblies as they are wound upon the mandrel;

a cutting and gluing module upstream of the mandrel and constructed to cut the packing material near the end of a finished roll and to apply adhesive to the end of the packing material to secure the finished roll;

a finished roll support proximate the mandrel for receiving a finished roll of packed spring assemblies; and a roll pusher proximate the first end of the mandrel and configured to engage a finished roll of material on the mandrel and push the roll toward the second end and off of the mandrel onto the finished roll support.

16. The apparatus of claim 15 further comprising a frame for supporting the pivot arm, the packing material dispensers, the precompression roller, and the cutting and gluing module.

17. The apparatus of claim 15, further comprising:

guide rails upstream of the mandrel; and castors fixed to the feed table and engageable with the guide rails such that the feed table may be moved toward and away from the mandrel along a path defined by the guide rails.

18. The apparatus of claim 15, further comprising:

side guides operatively associated with the feed table to facilitate feeding of spring assemblies to the mandrel and to ensure proper spacing between successive spring assemblies.

19. The apparatus of claim 15, further comprising:

a pneumatic cylinder operatively associated with the feed roller to adjust the position of the feed roller.

20. The apparatus of claim 15, further comprising:

a vacuum system operatively associated with the mandrel, the vacuum system operating to draw packing material toward the mandrel and facilitate winding of the packing material on the mandrel.

21. The apparatus of claim 15, further comprising:

a tension compensator associated with the packing material dispenser.

22. The apparatus of claim 15, further comprising:

a finished roll manipulator; and a finished roll palletizer, the finished roll palletizer including:

a pallet magazine, and a roll wrapping machine.

23. The apparatus of claim 15, further comprising:

a conveyor for receiving finished, wrapped rolls of roll packed spring assemblies.

* * * * *